US006694927B1

(12) United States Patent
Pouchak et al.

(10) Patent No.: US 6,694,927 B1
(45) Date of Patent: Feb. 24, 2004

(54) COLD WATER DRAW BYPASS VALVE AND VARIABLE FIRING BOILER CONTROL

(75) Inventors: Michael A. Pouchak, Saint Anthony, MN (US); Paul C. Wacker, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/368,322

(22) Filed: Feb. 18, 2003

(51) Int. Cl.[7] ..... F22B 37/42

(52) U.S. Cl. ..... 122/448.1; 219/483; 219/490; 219/508

(58) Field of Search ..... 122/20 R, 20 B, 122/13.01, 446, 447, 448.1, 448.2, 448.3; 219/483, 490, 508

(56) References Cited

U.S. PATENT DOCUMENTS 5,154,162 A * 10/1992 Chang ..... 122/14.21
5,960,558 A 10/1999 Bourgault
6,055,944 A * 5/2000 Santiago ..... 122/14.22
6,390,027 B1 * 5/2002 Lyons et al. ..... 122/14.2
6,401,669 B1 6/2002 Macgowan et al.

* cited by examiner

*Primary Examiner*—Jiping Lu

(57) ABSTRACT

A first sensor provides a demand for heat signal to a condensing boiler or water heater for control of the variable firing rate. A second sensor controls a bypass valve to allow a portion of water leaving the primary heat exchanger to reenter the primary heat exchanger. The bypass valve is controlled to maintain the temperature of water entering the primary heat exchanger above a minimum. When the boiler is operating at a reduced firing rate based on the demand for heat and an increase in firing rate is needed to maintain the temperature of water entering the primary heat exchanger above the minimum, the variable firing rate is increased.

23 Claims, 4 Drawing Sheets

Fig. 1
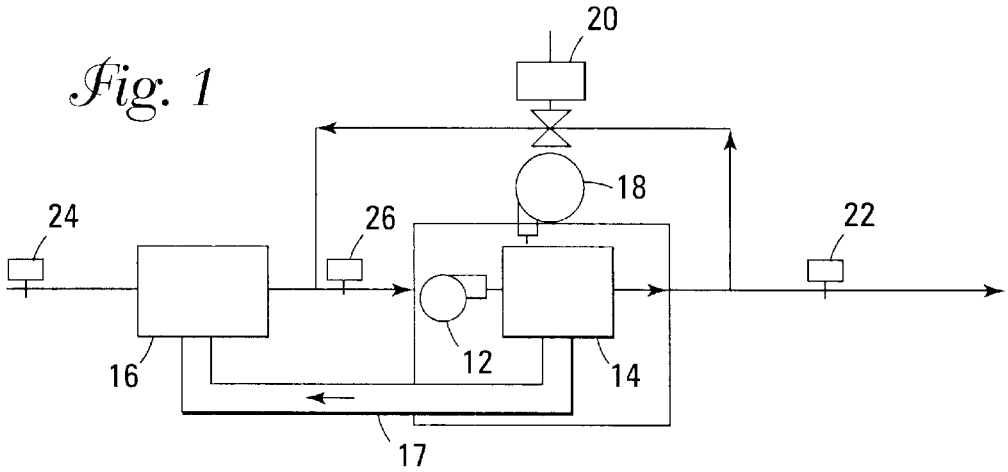
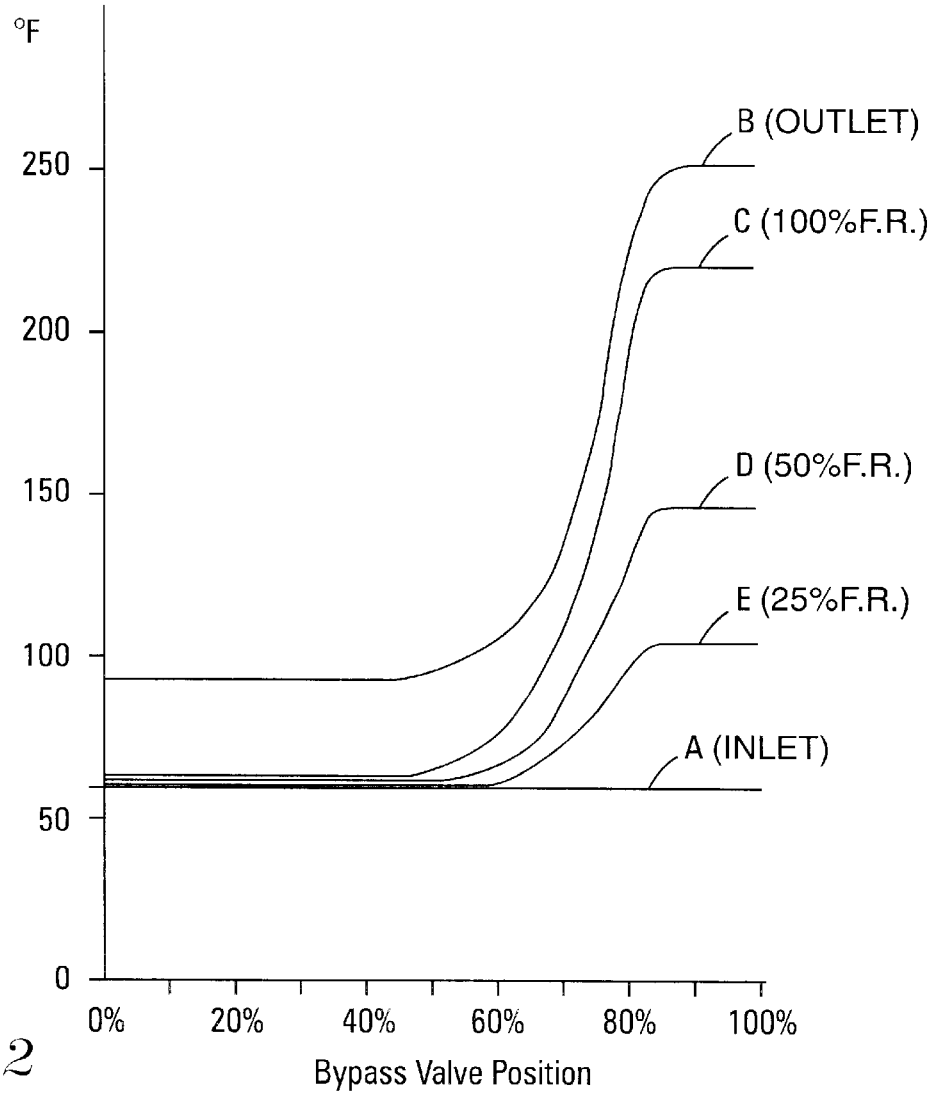
Fig. 2

COLD WATER DRAW BYPASS VALVE AND VARIABLE FIRING BOILER CONTROL

BACKGROUND OF THE INVENTION

The invention relates in general to control systems for hot water boilers or water heaters, and particularly to control systems for high efficiency condensing boilers or water heaters typically used for domestic hot water that utilize a variable firing rate. The invention will be described in relation to a hot water boiler, but it is to be understood that the invention applies as well to a water heater.

The application of a thermostat to boiler control has traditionally been handled by an electromechanical control that presents a digital (on or off) request for heat to a flame safety controller that would actuate a gas valve and purge system on a gas boiler. With the advent of microprocessor-based controls, many new features allow display and control of thermostat information, e.g., setpoint information and control point status on an annunciator screen.

Flame safety boiler controls directly affect those elements that may cause an unsafe condition. Flame safety controls have very high safety standards and require strict testing and failure analysis, particularly for microprocessor-based controls. The required levels of safety, testing, and failure analysis significantly increase the difficulty and cost of implementing controls that meet these standards. Customization and feature enhancements of flame safety controllers are prohibitively expensive due to the cost of certification and testing. Components of the gas-flame safety controller ignition cycle include safety checks, pre-purge, igniter surface preparation, trial for ignition, gas valve actuation, ignition, and post-purge. Manufacturers of flame safety products typically provide flame safety controllers to an original equipment manufacturer (OEM) for boilers. The OEM then integrates these controls into their boiler designs. Some of the boiler control products also incorporate temperature control sensing and setpoints into the device, but these are usually limited to single standalone boiler devices.

Certain boilers can be designed to utilize a secondary heat exchanger which is designed to accommodate condensation of flue gases and removal of the condensate. Such "condensing boilers" will have an efficiency that is significantly higher than a traditional boiler design having only a single heat exchanger. These "condensing" designs typically require that a portion of the water leaving the primary heat exchanger can be routed or fed back to the entering side of the primary heat exchanger. This feedback loop of hot water is to ensure that the water temperature to the main heat exchanger does not go below the condensing temperature of the waste combustion gas, typically around 135 degrees F. In the past, this feedback loop often included a manually controlled valve that could be fixed in a position to allow a portion of the leaving water to bypass the heating coils or other heating elements that transfer heat to the conditioned building and be recirculated through the primary heat exchanger. Other systems in the past had a temperature sensor located in the inlet of the primary heat exchanger which controlled a valve that allowed more or less leaving water to be recirculated, depending on the temperature at the sensor.

New gas valve technologies have evolved that will automatically adjust the boiler combustion air-to-fuel-ratio based on the air pressure of firing rate combustion rate. With the new gas valve technologies, the addition of a variable frequency drive (VFD) allows for "modulating" or controlling the firing rate of the boilers from a low firing rate to a high firing rate as a function of the demand for heat. In addition, VFD allows purging of the combustion chamber when as is not intended to be present.

Since the boiler is high efficiency, condensation of flue gases is expected to occur in the secondary heat exchanger. If the water temperature at the bypass temperature goes below the condensation temperature for the flue gas, say at 135 degrees F, it would be possible to have condensation at the primary heat exchanger, which is typically considered damaging and undesirable. The bypass valve can be modulated to allow feedback of hot water to warm up the bypass temperature, but if the firing rate is too low on the variable speed fan that generates heat (possibly due to control requirements), the bypass temperature may drop below 135 degrees and allow condensation. The problem just described can occur in situations such as seasonal start up of a boiler system, transition from an unoccupied period to an occupied period where lowered space temperatures were deliberately maintained during the unoccupied period, and specialized low temperature applications. Boiler manufacturers manufacture and distribute high-efficiency boilers without having knowledge about the details of the type of application or end use in which the boiler will be used. Specialized low temperature applications include boiler systems located in low ambient heat spaces, or supplying heating water at lower than normal heating water temperatures. For example, a boiler could be used in a cold climate to heat water for a snow/ice melting system where the water is piped through a concrete driveway or sidewalk. A water heater could be applied to heating a very large reservoir of cold water. Certain low-water-temperature industrial applications are also possible. There is a desire to protect the primary heat exchanger from damage due to condensation at the expense of less than optimum energy efficiency.

Manufacturers of fixed firing rate systems and single stage boilers have attempted to solve this problem by having complex control and interactions with bypass temperature, and flame safety, PID, and other conventional control technologies. Other controls have focused on full on/off firing rates controls and have not dealt effectively with the partially loaded system that is not at full firing rates.

In addition, for reasons of cost effectiveness, the bypass valve is often a butterfly type valve which typically has a percent open versus percent maximum flow rate that is quite nonlinear. A linear relationship between changes in valve position and changes in flow allows stable control to be more easily achieved. A nonlinear relationship or characteristic can lead to control stability problems where a simple control algorithm, for example, proportional control, is used.

Thus, a need exists for a control system for a high efficiency variable firing rate boiler where a bypass valve is controlled to maintain a water temperature entering the primary heat exchanger above the recommended minimum temperature.

SUMMARY

The present invention solves these and other needs by providing a control system for a boiler having a variable firing rate, a bypass valve, a primary heat exchanger, and a secondary heat exchanger. A first sensor provides a signal representative of a demand for heat from the boiler for control of the variable firing rate. A bypass valve allows a portion of water leaving the primary heat exchanger to pass through the bypass valve and reenter the primary heat exchanger. A second sensor provides a second signal representative of a temperature of water entering the primary heat exchanger. The position of the bypass valve is controlled to maintain the temperature of water entering the primary heat exchanger above a first temperature. Under conditions when the boiler is operating at a reduced firing rate based on the demand for heat and an increase in firing rate is needed to maintain the temperature of water entering the primary heat exchanger above the first temperature, the variable firing rate is increased.

BRIEF DESCRIPTION OF THE DRAWINGS

FIG. 1 is a diagram of a single variable firing rate boiler arrangement illustrating the environment of the present invention.

FIG. 2 shows hypothetical bypass characteristic curves for an assembly of an actuator and a butterfly valve in the piping arrangement of FIG. 1.

DESCRIPTION OF THE PREFERRED EMBODIMENT

Figure 3:
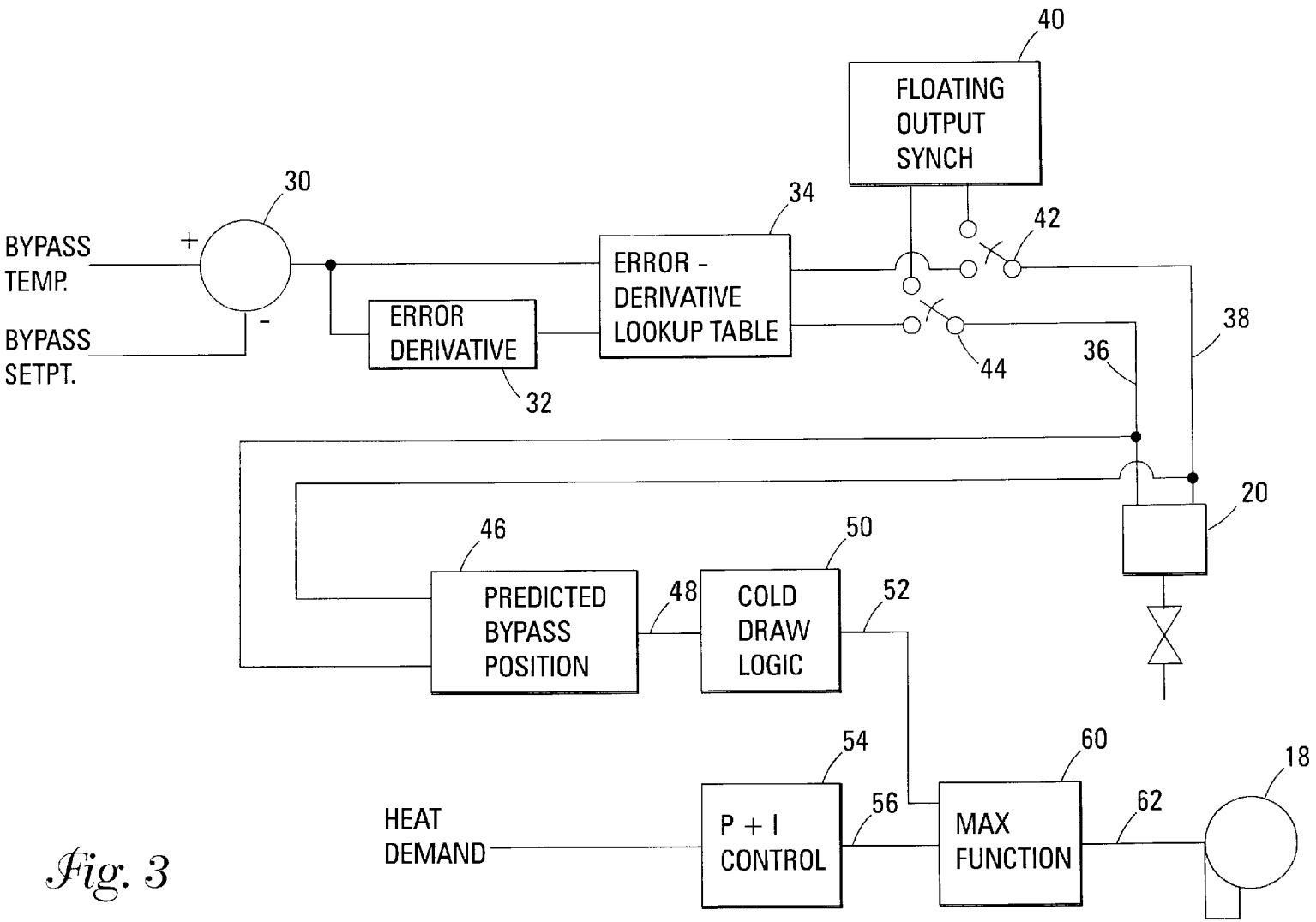
FIG. 3 is a functional block diagram of the cold water draw bypass valve and variable firing boiler control of the present invention.

A single boiler arrangement is shown in FIG. 1 including water circulating pump 12, primary heat exchanger 14, and secondary heat exchanger 16 which utilizes combustion waste heat 17. Bypass or recirculating valve 20 insures that a minimum water temperature is maintained in the boiler by bypassing the heating units (not shown) that are used to distribute the heat provided by the boiler. Supply or outlet water temperature sensor 22, return or inlet water temperature sensor 24, and bypass water temperature sensor 26 are also shown. A variable firing rate is provided for the boiler by variable frequency drive (VFD) combustion/purge blower 18. Other techniques for providing a variable firing rate could be used.

This current invention is an extension to a bypass control algorithm. The invention will sacrifice the temperature control of the unit under certain conditions by increasing the VFD speed over the normal control VFD command to allow hot water to feedback and allow the 135-degree bypass temperature to be maintained in cold water draw situations.

FIG. 2 shows hypothetical bypass characteristic curves for a valve actuator connected to a single butterfly valve to form a bypass valve assembly 20 as shown in the configuration of FIG. 1. Water temperature in degrees Fahrenheit is shown on the vertical axis and the physical percentage open of the butterfly valve is shown on the horizontal axis. Curve A shows the inlet temperature or temperature entering secondary heat exchanger 16 and curve B shows the temperature at the "outlet", i.e., at sensor 22, for a firing rate of 100%. Curves C, D, and E show the bypass temperature, i.e., at sensor 26, for firing rates of 100%, 50%, and 25% respectively. The slope of curves C, D, and E is equal to the degrees F change divided by the % bypass position. It is apparent from FIG. 2 that for the described arrangement, the relationship of valve position to flow is extremely nonlinear. For example, with reference to the 100% firing rate curve C, the valve characteristic on opening is relatively flat until the valve is about 50% open. For greater percentages open, for example, when the valve changes from 70% to 80%, the bypass temperature changes from about 120 degrees to about 200 degrees. That is, a 1% change in valve position corresponds to an 8.0-degree change in bypass temperature. This extreme nonlinearity is accommodated by the present invention as will be explained.

FIG. 3 illustrates the control of bypass valve 20 and, under certain conditions, the control of VFD 18 as a function of bypass temperature 26 according to the principles of the present invention. A measured value for the bypass temperature as determined from sensor 26 is input to control block 30 which compares the setpoint to the measured valued. An error is calculated to be error=bypass temp−bypass setpoint and provided to calculation module 32 and error-derivative lookup table module 34. A rate of error is calculated by module 32 for the derivative term and provided to error-derivative lookup table module 34. Module 34 provides a change rate signal, i.e., a specific number of 100 millisecond pulses per second. The change rate signal includes direction, e.g., change rate signal on lead 36 drives valve actuator 20 toward open position, and change rate signal on lead 38 drives the actuator toward closed position. Floating output synchronizer 40 coordinates providing synchronization signals 36, 38 to bypass valve 20 by controlling contacts 42 and 44. Predicted bypass position (PBP) module 46 accumulates the direction and magnitude rate change signal 36 or 38, calculates a predicted position of bypass valve 20, and provides signal 48 to cold draw logic (CDL) module 50. In this embodiment, PBP module 46 is designed to accumulate bypass position beyond the 100% bypass position to 200%. That is, it may not be possible to maintain the desired minimum water temperature entering primary heat exchanger 14 even though bypass valve 20 is physically in the 100% open position. This situation could occur in applications previously described, e.g., boiler water used for a snow melting system. In this situation, the accumulated bypass position signal beyond 100% provides a signal representative of the need to increase the variable firing rate.

Cold draw logic module 50 accepts and processes predicted bypass position signal 48 and provides signal 52 which represents the predicted bypass position—100%. Signal 52 is an input to maximum function module 60. A signal representative of a demand for heat is input to proportional+integral (P+I) controller 54. Signal 56 from PHI controller 56 is also an input to module 60. Output 52 is the higher of signal 52 and signal 56 and controls the firing rate of VFD 18.

Figure 4:
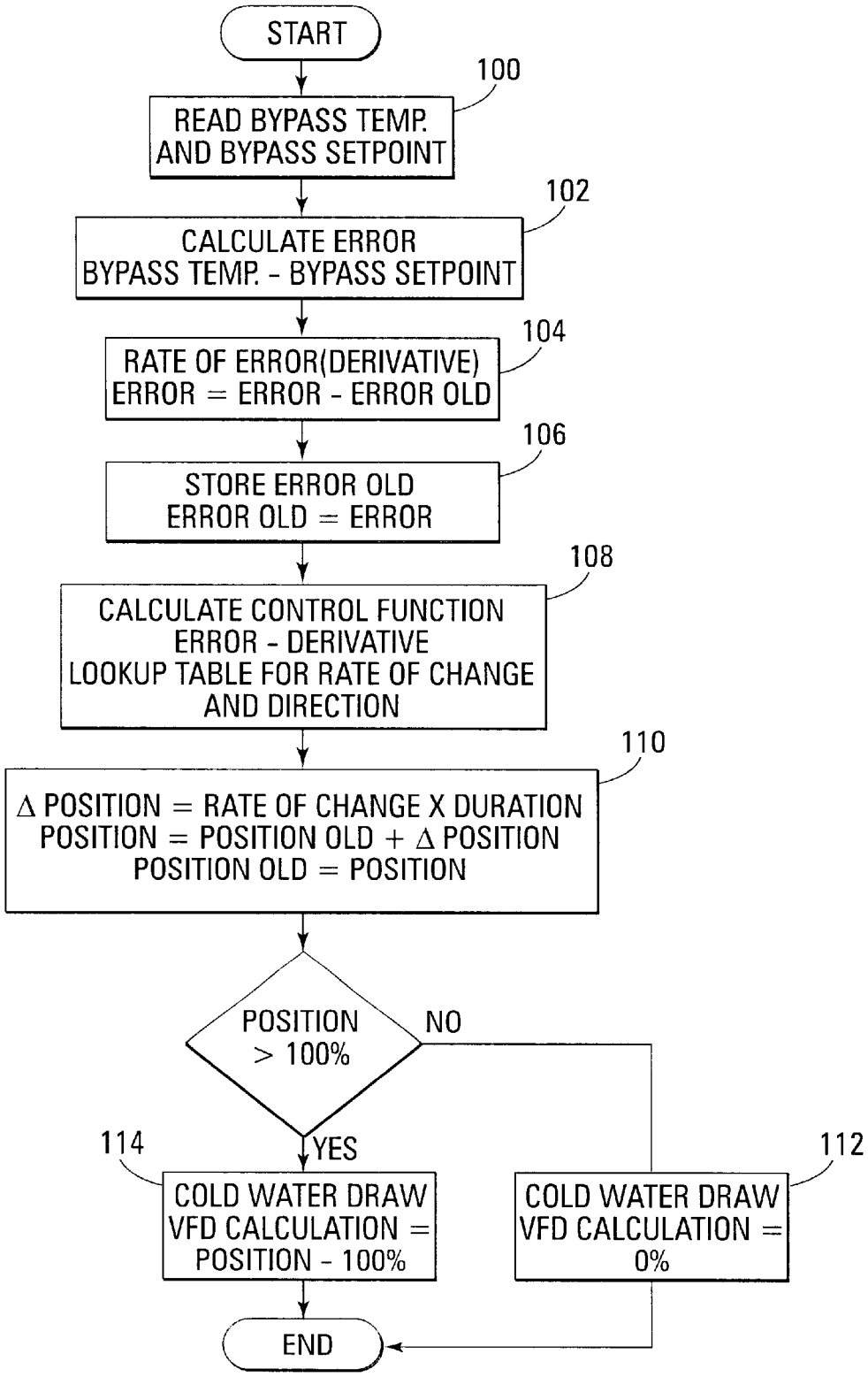
FIG. 4 is a flowchart diagram illustrating the preferred operation of modules of FIG. 3.

The actual decision logic of FIG. 3 will be explained below with reference to FIG. 4. The routine begins at step 100 by reading a bypass temperature and a bypass set point. Next at step 102 , the error=bypass temperature−bypass setpoint is calculated. At step 104 a derivative of error or rate of error=error new−error old is calculated. By storing the current error at step 106 to be available as the old error for the next error rate calculation, the derivative rate of error is calculated and provided.

Next, at step 108, the calculation of error rate for the floating actuator is determined from a lookup table. The lookup table is a table with an input value of error+(K) * Error rate (where K is some derivative gain factor). A simplified lookup table is shown as Table 1. The combined value of error and error rate term is used to look up a change rate for the floating actuator. In the preferred embodiment the change rate can change from 0 to 1 second per 1 second period by 100 ms increments (0 to 100% control rate per 1 second period), additionally determining open and close direction.

TABLE 1

| Error | Rate | Direction |
|---|---|---|
| −1 | 500 ms | −1 |
| 0 | 0 | 0 |
| +1 | 500 ms | +1 |

The rate of change and direction is fed to the floating actuator 20, resulting in some integral change to the valve position. At step 110 the rate of change times the time duration will result in the calculation of a Δ position. The Δ position is added to the current calculated position of the valve. The current position is stored for future calculation of the next position. At step 112, a position less than 100% results in a calculation of VFD=0%. As the calculated position of the valve exceeds 100%, the physical valve cannot open any further, however at step 114 the accumulated value minus 100% is fed on to CDL module 50.

The output of error-derivative lookup table module 34 is a signal direction and magnitude rate change signal, which varies from 0 to 100% of change per control period. In the embodiment of FIG. 3, this is intended for a floating output actuator. For example, if a 165-second floating actuator is used, and the control period is 1 second, then a 100% change per control period (one second) is equivalent to a position change of 1/165×100 percent.

Figure 5:
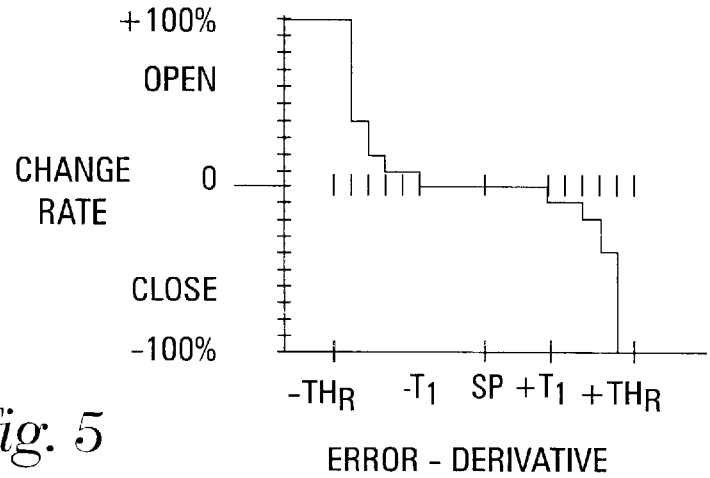
FIG. 5 shows a response characteristic for the system of FIG. 3.

With reference to FIG. 5, as the error-derivative control function deviates to the Throttling Range (−THr) the change rate will go to +100% rate or change at 1/165×100% rate per second. In the current system, if the bypass position goes to 100% and yet the measured value is not within the deadband (+−T1) of the error-derivative, then additional changes are not used.

Figure 6:
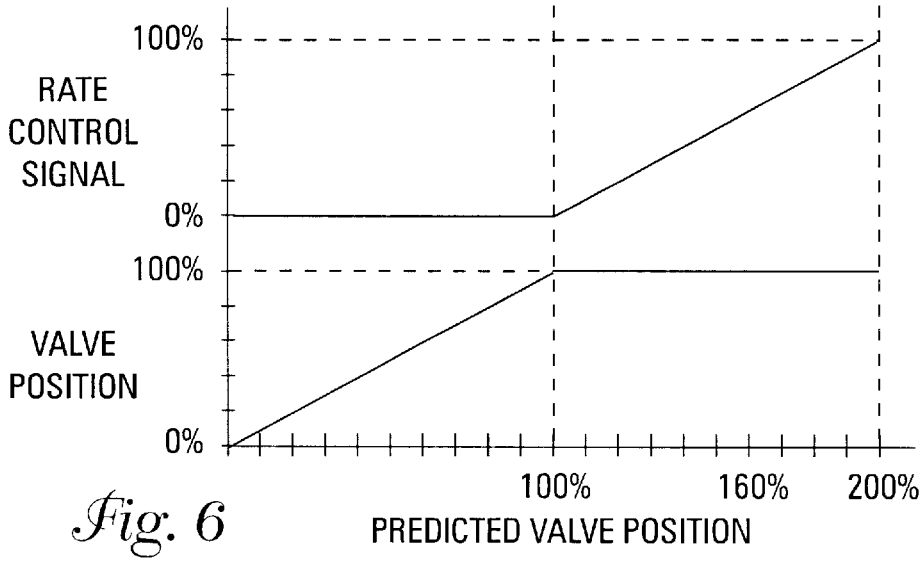
FIG. 6 shows a predicted position for a bypass valve of FIG. 3.
Figure 7:
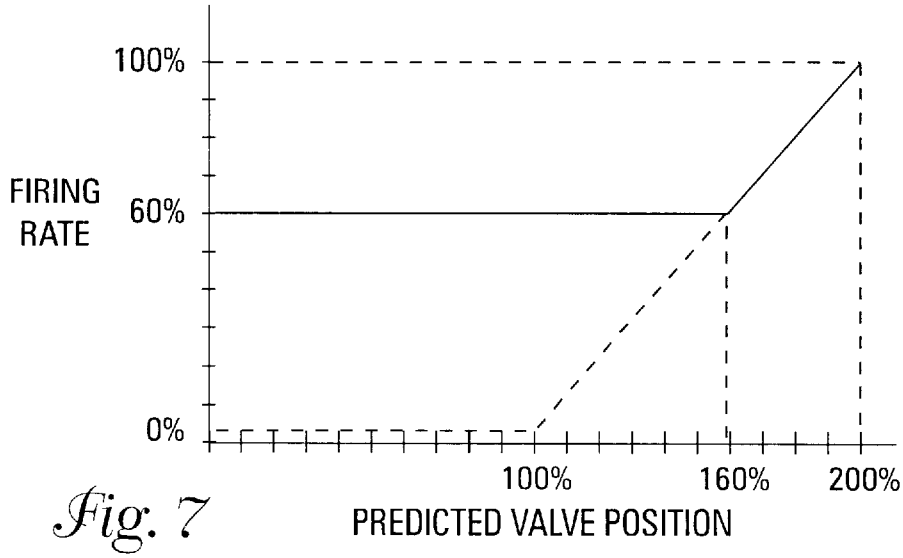
FIG. 7 shows a signal of FIG. 3 in relation to a reduced demand for heat signal.

The present invention implements the extension of accumulated bypass position to accumulate over 100%. FIG. 6 shows physical valve position on a first portion of the vertical axis related to predicted valve position. FIG. 6 also shows that for accumulation of bypass position from 100 to 200% (even though the bypass position cannot physically exceed 100%) the signal (rate control signal) above 100% is allowed to variably control or modulate the minimum firing rate to the VFD. The VFD firing rate is typically controlled by a separate proportional plus integral (PI) controller or other type of controller. The VFD will use the higher (MAX) of either the VFD firing rate signal 52 from the Cold water draw logic module 50 or the VFD firing rate signal 56 from the P+I control 54. The effect is if the VFD is commanded at 60% firing rate and the bypass temperature is still not satisfied at 100% bypass valve position, then the windup of the bypass valve predicted position over 160% will eventually cause the VFD firing rate from the cold water draw logic to win and take over the VFD firing rate as illustrated in FIG. 7.

Eventually in single and multistage applications, the VFD firing rate from the controller may be trying to control at a low VFD speed, but due to the use of the present invention, the VFD firing rate may indeed be high. If the VFD firing rate is overheating the system that was lightly loaded, then the system temperature may rise such that the entire stage may turn off. This may lead to shorter cycling of the boiler. It is generally believed that this is acceptable to protect the boiler from damage to the primary heat exchangers by condensation, and this situation (shorter cycling) should be rare based on application of cold-water draw boiler loads.

The present invention has been illustrated using an arrangement of a butterfly valve and actuator utilizing floating control because a butterfly valve is often used in such applications. However, the invention applies as well to other valve body types or constructions, and to other types of control. For example, a valve assembly of a two-way single seated valve and an actuator utilizing another type of control could be used. In addition to its use with various two-way valves, the present invention also has application to three-way valves that control the flow of liquids. For example, the invention may be used with a three-way valve designed for mixing applications or a three way-valve designed for diverting applications. The piping arrangements to achieve a bypass flow path for boiler water using such valves are well known.

One advantage to this solution is that the control affecting the VFD firing rate is unaffected, and simple changes are made only to the bypass control algorithm. In a multiple boiler system, this means that no communication is necessary to coordinate back to the staging algorithm, and automatic control is achieved within a single boiler.

In advanced applications that try to produce the maximum efficiency for multiple stages by turning on more stages at a lower firing rate, it would be desirable to feedback a signal that the VFD firing rate from the cold water draw logic exceed the VFD firing rate from the normal boiler control and that adding addition stages to increase efficiency is not desired.

In accordance with the foregoing description, Applicant has developed a solution to the control of a cold-water draw bypass valve and variable firing boiler. Applicant's solution is easily incorporated into the design of boiler control systems. Although a specific embodiment of Applicant's cold-water draw bypass valve and variable firing boiler control is shown and described for illustrative purposes, a number of variations and modifications will be apparent to those of ordinary skill in the relevant arts. Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than the foregoing description, and all changes which come within the meaning and range of equivalency of the claims are intended to be embraced therein.

What is claimed is:

1. A control system for a water heating apparatus having a variable firing rate, said apparatus having a bypass valve, a primary heat exchanger, and a secondary heat exchanger, said control system comprising:

a first sensor providing a signal representative of a demand for heat from said apparatus;

said first signal controlling said variable firing rate based on said demand;

said bypass valve allowing a portion of water leaving said primary heat exchanger to pass through said bypass valve and reenter said primary heat exchanger;

a second sensor providing a second signal representative of a temperature of said water entering said primary heat exchanger;

means for controlling a position of said bypass valve to maintain said temperature of water entering said primary heat exchanger above a first temperature; and means for controlling said variable firing rate under conditions when said apparatus is operating at a reduced firing rate based on said demand for heat and an increase in firing rate is needed to maintain said temperature of water entering said primary heat exchanger above said first temperature.

2. The control system of claim 1 wherein said bypass valve comprises an actuator and said means for controlling a position of said bypass valve comprise periodic corrective signals to said actuator.

3. The control system of claim 2 wherein said periodic corrective signals have a rate of change and a direction of change.

4. The control system of claim 3 wherein said means for controlling said variable firing rate comprises:

means for predicting a position of said bypass valve; and means for selectively controlling said variable firing rate from said demand for heat or from a predicted position of said bypass valve.

5. The control system of claim 4 wherein said means for predicting a position of said bypass valve comprises means for processing said periodic corrective signals to determine incremental changes in said position.

6. The control system of claim 8 wherein a predicted position of said bypass valve may exceed 100 percent.

7. The control system of claim 5 wherein said means for selectively controlling said variable firing rate from said demand for heat or from a predicted position of said bypass valve comprises means for comparing a signal related to a demand for heat to a signal related to said predicted position.

8. The control system of claim 1 wherein said bypass valve comprises a butterfly valve and an actuator.

9. The control system of claim 5 wherein said means for controlling said bypass valve comprises a derivative control mode.

10. The control system of claim 1 wherein said bypass valve comprises a three-way valve and an actuator.

11. A control system for a boiler or a water heater having a variable firing rate, said boiler having a bypass valve, a primary heat exchanger, and a secondary heat exchanger, said control system comprising:

a first sensor providing a signal representative of a demand for heat from said boiler or water heater;

said first signal controlling said variable firing rate based on said demand;

said bypass valve allowing a portion of water leaving said primary heat exchanger to pass through said bypass valve and reenter said primary heat exchanger;

a second sensor providing a second signal representative of a temperature of said water entering said primary heat exchanger;

means for defining a control range having a first portion and a second portion;

means for controlling a position of said bypass valve in said first portion; and means for controlling said variable firing rate in said second portion when said boiler or water heater is operating at a reduced firing rate based on said demand for heat and an increase in firing rate is needed so as to maintain a water temperature above said first temperature.

12. The control system of claim 11 wherein said means for predicting a position of said bypass valve comprises means for processing said periodic corrective signals to determine incremental changes in said position.

13. The control system of claim 12 wherein a predicted position of said bypass valve may exceed 100 percent.

14. The control system of claim 11 wherein said bypass valve comprises an actuator and said means for controlling comprise periodic corrective signals to said actuator.

15. The control system of claim 14 wherein said bypass valve comprises a butterfly valve and an actuator.

16. The control system of claim 15 wherein said means for controlling said bypass valve comprises a derivative control mode.

17. The control system of claim 11 wherein said means for controlling said variable firing rate comprises:

means for predicting a position of said bypass valve;

means for selectively controlling said variable firing rate from said demand for heat or from a predicted position of said bypass valve.

18. The control system of claim 11 wherein a predicted position of said bypass valve may exceed 100 percent.

19. A method of control for a boiler or water heater having a variable firing rate, a primary heat exchanger, a secondary heat exchanger, and a bypass valve for allowing a portion of water leaving said primary heat exchanger to pass through said bypass valve and reenter said primary heat exchanger, said method comprising:

periodically measuring a temperature of water entering said primary heat exchanger;

comparing said temperature to a set point temperature;

calculating a temperature error and a temperature error rate;

issuing corrective signals to said bypass valve;

accumulating said corrective signals to establish a location within a defined control range;

apportioning said defined control range into a first portion and a second portion;

controlling a physical position of said bypass valve within said first portion; and controlling said variable firing rate within said second portion.

20. The method of claim 19 wherein said accumulating said corrective signals to establish a location within a defined control range comprises predicting a position of said bypass valve wherein said predicted position may exceed a 100% open position.

21. The method of claim 19 wherein said bypass valve comprises a butterfly valve and a floating control actuator.

22. The method of claim 19 wherein said bypass valve comprises a three way valve.

23. The method of claim 19 wherein said controlling said variable firing rate within said second portion comprises selecting a control signal representative of heating demand or a control signal representative of said temperature of water entering said primary heat exchanger.

* * * * *